United States Patent [19]

Martin, Jr. et al.

[11] 4,081,107

[45] Mar. 28, 1978

[54] VENTING CLOSURE ASSEMBLY FOR MILK TANK OR THE LIKE

[75] Inventors: Timothy J. Martin, Jr., Lynden; David C. Waschke, Everson, both of Wash.

[73] Assignee: Light Industrial Design Co., Inc., Sumas, Wash.

[21] Appl. No.: 774,874

[22] Filed: Mar. 7, 1977

[51] Int. Cl.[2] ..... B65D 41/10

[52] U.S. Cl. ..... 220/374; 220/373; 215/310

[58] Field of Search ..... 220/367, 373, 374; 215/307, 310

[56] References Cited

U.S. PATENT DOCUMENTS 3,128,899 4/1964 Runo ..... 220/374

3,286,873 11/1966 Tuckey ..... 220/374

*Primary Examiner*—George T. Hall

[57] ABSTRACT

A venting closure assembly extending across an access opening on the top part of a milk tank. There is a venting closure member having perimeter flange members which fit against a support ring of the milk tank to form one or more circumferential venting channels. A cover having a vent opening fits over the closure member and engages the peripheral portions thereof to form a circumferential seal against the support ring. The venting channel or channels connect to circumferentially spaced openings on the flanges to provide venting from inside the tank to the area outside the tank, while preventing both spilling of the milk and contamination from outside sources.

22 Claims, 8 Drawing Figures

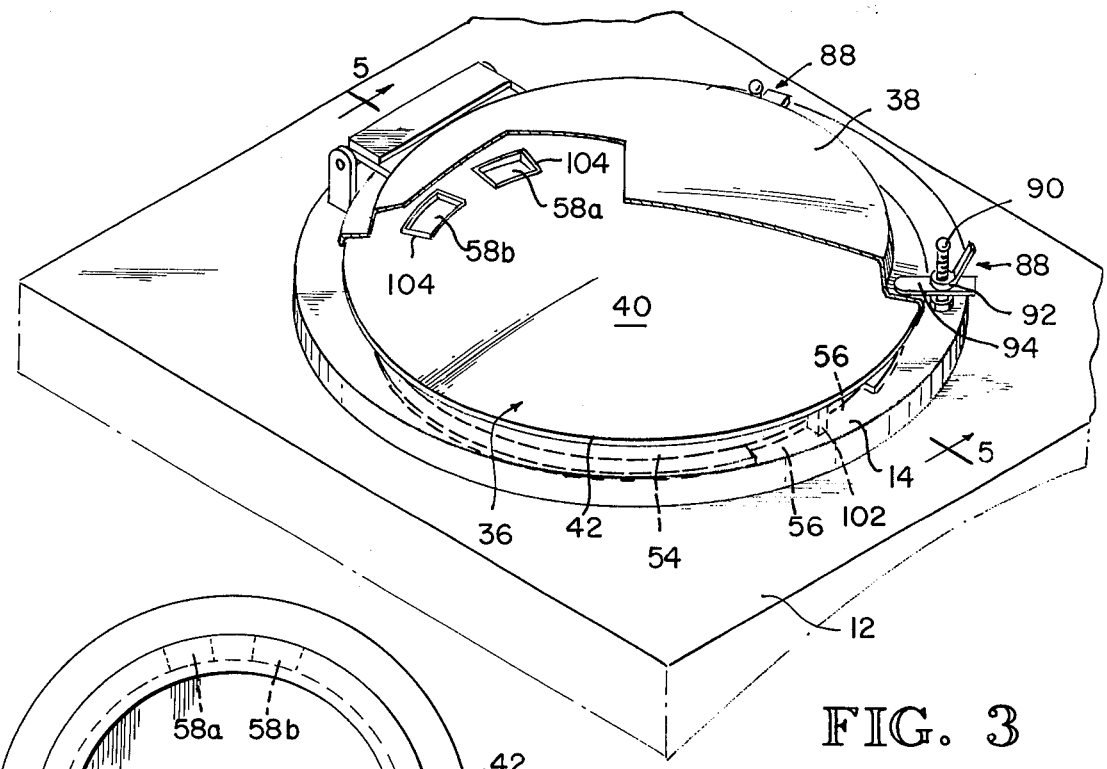
FIG. 3
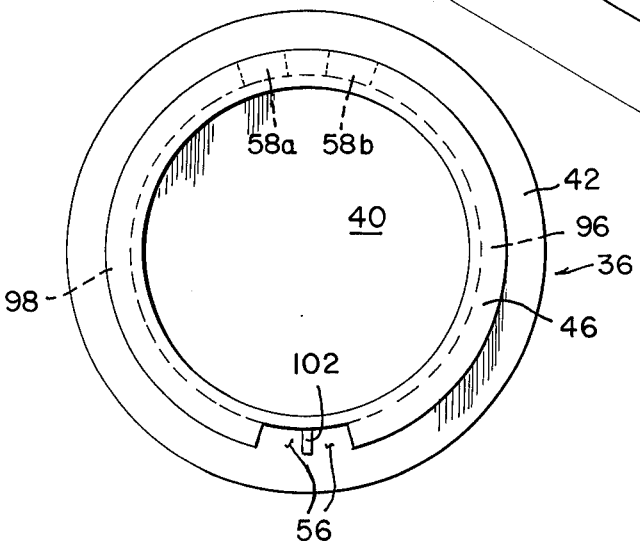
FIG. 4
FIG. 5
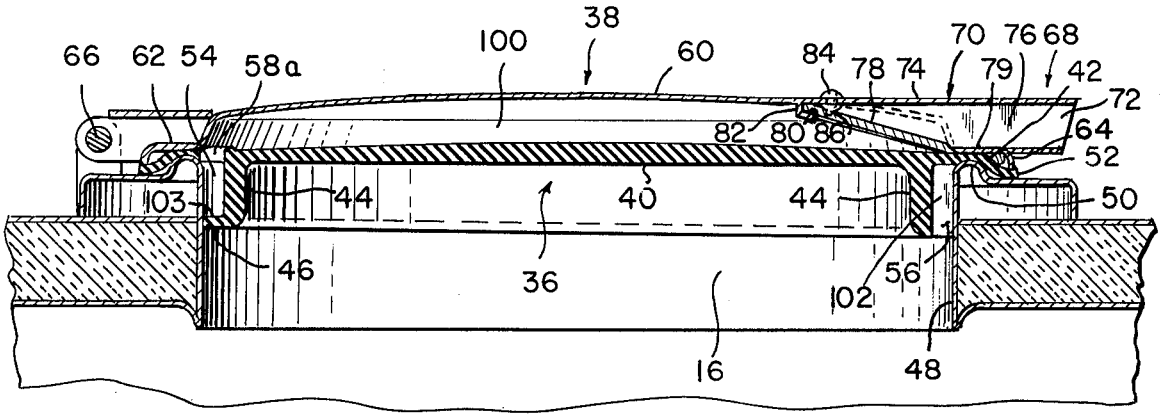

FIG. 6
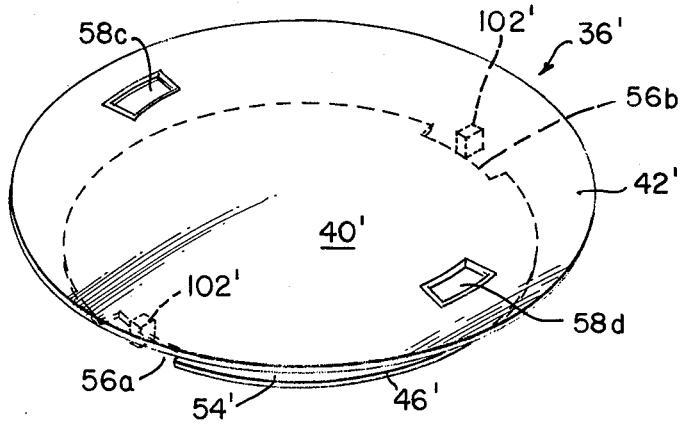
FIG. 7
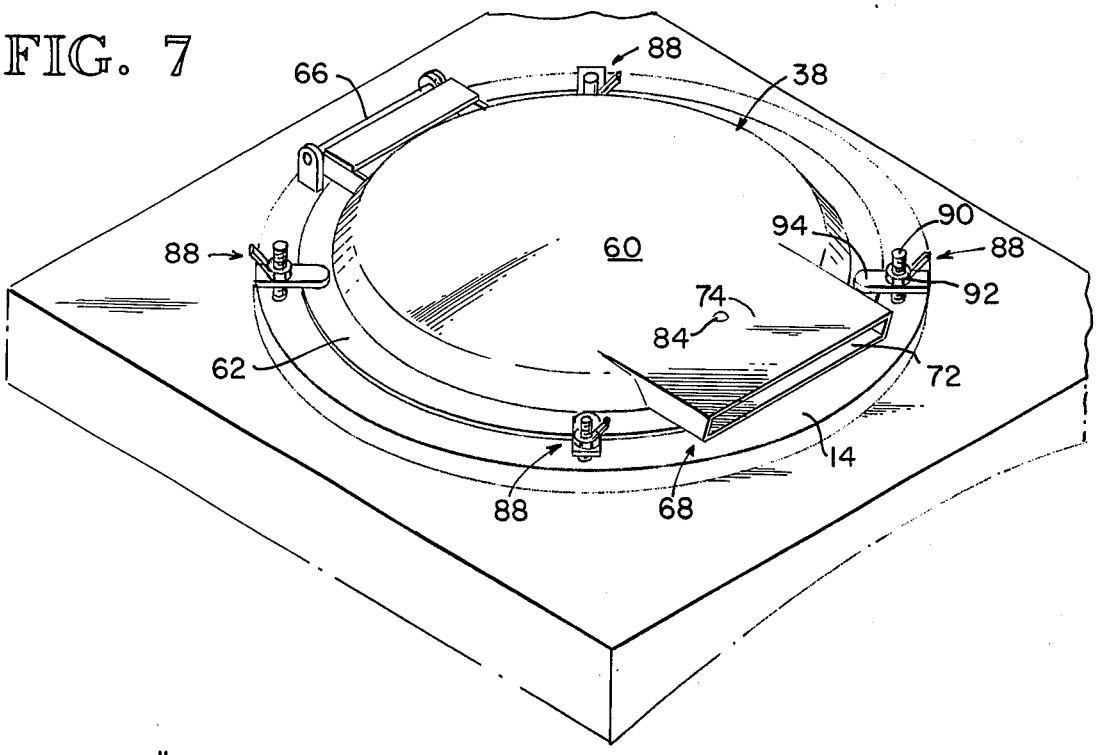
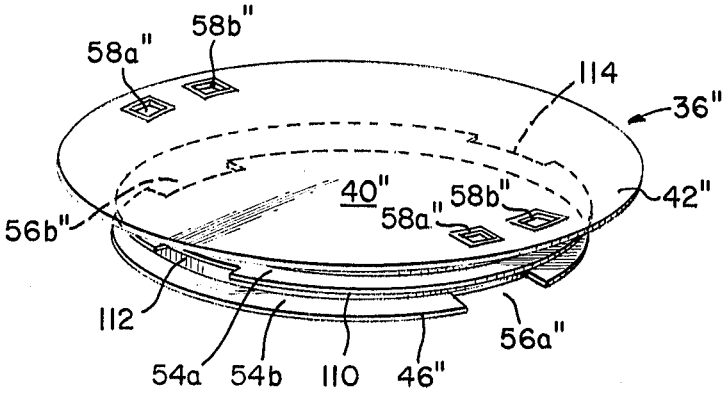
FIG. 8

VENTING CLOSURE ASSEMBLY FOR MILK TANK OR THE LIKE

BACKGROUND OF THE INVENTION

A. Field of the Invention

The present invention relates to a vented closure assembly for a containing structure, such as a milk tank.

B. Brief Description of the Prior Art

In the dairy industry, milk is commonly transported from dairy farms to a central processing center by means of tank trucks and trailers. The milk-containing tank itself is generally made of stainless steel and is commonly of a double-walled construction with insulation between the inner and outer stainless steel walls, so that the contained milk can be kept at an adequately low temperature while being transported.

Because of the sanitation requirements of the dairy industry, the interior of the milk tank must be thoroughly washed at regular intervals. Also, it is necessary to provide the tank with an access opening, commonly called a "manhole," to permit an inspector to actually enter the interior of the tank. Obviously, while milk is being transported, this access opening must be properly covered both to prevent milk from being spilled out the opening, and also to prevent outside contaminants from being mixed with the milk. There is a further requirement that the interior of the tank be vented to the outside atmosphere, since with an airtight tank even small temperature variations in the milk would cause undesired pressure differentials between the area inside the tank and the surrounding atmosphere.

A quite common means of providing the venting in a milk tank is to provide a venting member in an interior metal cover which normally closes the access opening of the tank. This venting member generally comprises a cylindrical tube mounted to the center of the cover and extending downwardly toward the interior of the tank. The interior of the tube is provided with a set of vertically spaced, staggered baffles which overlap sufficiently to define a circuitous passageway from the interior to the exterior of the tank. An annular gasket member made of a flexible material is usually placed between the perimeter portion of the cover and the support ring which defines the tank access opening, to provide a perimeter seal. Also, an exterior dust cover is positioned over the interior cover. The sanitation standards of the dairy industry require that all components which possibly come into contact with the milk be thoroughly cleaned at regular intervals.

While the prior art closure assemblies have been able to perform the closing and venting functions for a milk tank in a manner to meet the standards of the dairy industry, there is a continuing need for improvement, with regard to such things as simplicity of structure, ease and reliability of operation, capability of being thoroughly cleaned, and low cost of initial fabrication, as well as low cost in operation and maintenance. It is an object of the present invention to provide an improved closure assembly for a milk tank or the like, which incorporates a desired balance of advantageous features, with regard to the factors indicated above.

SUMMARY OF THE INVENTION

In the closure assembly of the present invention, there is a support ring mounted to a containing structure, such as a milk tank, which support ring has a perimeter wall defining an access opening leading into the interior of the containing structure. There is a venting closure member extending across the opening, this closure member having a central area and a perimeter area adjacent a perimeter wall of the ring member. This closure member is shaped to define:

a. at least one perimeter venting channel extending at least a substantial distance along the perimeter area of the closure member, b. at least one first interior vent opening leading from an interior area of the containing structure to said venting channel at a first perimeter location, and c. at least one second exterior vent opening leading from the venting channel to an area exterior of the containing area, said second vent opening being at a second perimeter location spaced a substantial perimeter distance from said first location adequate to impede passage of milk through the interior vent opening and out the second opening.

A vented dust cover member fits over the venting closure member and has an outside vent opening communicating with the exterior opening of the venting closure member. This outside vent opening is conveniently provided at one edge of the cover in the form of a laterally directed enclosure which defines a lateral opening having a filter therein which permits the passage of air either into or from the interior of the tank.

In a first embodiment, the venting closure member has a pair of upper and lower laterally extending perimeter flanges which define therebetween the perimeter venting channel. The upper flange extends over the upper edge of the support ring to provide an overlapping seal portion, and the cover presses this overlapping seal portion of the upper flange against the upper edge of the support ring to form a peripheral seal around the support ring of the closure assembly. The lower flange extends laterally in a radially outward direction to press against the perimeter side wall of the support ring in sealing relationship therewith.

There is a first interior vent opening formed as a cut-out in the lower flange of the venting closure member at a first perimeter location. A second exterior vent opening is formed in the upper flange at a perimeter location spaced a substantial perimeter distance from the location of the first venting opening, which in this embodiment is approximately 180° from the location of the first vent opening. For structural reasons this second vent opening is formed as a pair of closely adjacent cut-outs. Thus, the vent passage from the interior of the tank is through the first interior vent opening, along the peripheral channel extending around the closure member, thence through the second exterior vent opening, and then through the vent opening in the cover. In the event that any of the contained liquid in the tank (e.g., milk) splashes upwardly through the first interior vent opening into the peripheral venting channel, the liquid quite readily flows back through the first vent opening into the tank interior.

Desirably, the cross-sectional area of each of the first and second vent openings, the venting channel, and the vent opening of the cover is sufficiently large to create very little resistance to the inflow of air at a rate equal to the rate at which milk is normally pumped from a milk tank through a separate discharge opening in the tank. Generally, the milk is pumped through a 3-inch diameter hose at a rate of 250 to 325 gallons per minute. It has been found that if the total cross-sectional area of the vent passages, of the interior opening or openings and of the exterior opening or openings is each equal to about 4 square inches, there is adequate inflow of air to substantially balance the outflow of liquid in a manner that no pressure differential of any significance is developed between the inside and outside of the tank. The advantage of this is that it is not necessary to remove the closure member and the cover to pump the milk from the tank. The cross-sectional area of the vent opening in the cover must be made several times larger than each of the other openings to allow for the impedance of air flow due to the filter material in the opening.

In a second embodiment, the closure member has two interior vent openings spaced 180° from each other so as to be on opposite sides of the closure member. There are also two exterior vent openings in the closure member positioned 180° apart from each other, and offset 90° with respect to the two interior vent openings. Thus, the perimeter venting channel defined by the cover member actually provides four venting passageways, two of which lead from one interior vent opening to the two exterior vent openings, with the other two leading from the other interior vent opening to the two exterior vent openings.

In a third embodiment, in addition to the upper and lower flanges, there is an intermediate flange which forms with the other two flanges upper and lower perimeter venting channels extending around the periphery of the closure member. The bottom flange has two diametrically opposed interior vent openings. The intermediate flange likewise has two diametrically opposed intermediate vent openings offset 90° with respect to the interior vent openings. Finally, the upper flange has two diametrically opposed exterior vent openings offset 90° with respect to the intermediate vent openings and vertically aligned with the two interior vent openings. Thus, the vent passages extend from the two interior openings, along the lower venting channel to the intermediate openings, thence along the upper venting channels to the exterior vent openings.

Other features of the present invention will become apparent from the following detailed description of the invention.

BRIEF DESCRIPTION OF THE DRAWINGS

FIG. 3 is a perspective view of a closure assembly of the present invention, with a portion of the top cover of the closure assembly being cut away for purposes of illustration;

FIG. 4 is a bottom plan view of the venting closure member of the closure assembly of the present invention;

FIG. 5 is a transverse sectional view taken along line 5—5 of FIG. 3;

FIG. 6 is a perspective view of a closure member of a second embodiment of the present invention; FIG. 7 is a perspective view, similar to FIG. 3, of the closure assembly of the present invention with the vented dust cover being shown in its entirety; and FIG. 8 is a perspective view of a closure member of yet a third embodiment of the present invention.

DESCRIPTION OF THE PREFERRED EMBODIMENT

As indicated earlier herin the closure assembly of the present invention is particularly adapted for use with milk tank trucks or trailers. It is believed that a better appreciation of the novel features of the present invention will be obtained by first reviewing the general type of prior art closure apparatus now commonly in use, and then describing the present invention. A typical prior art apparatus is shown in FIGS. 1 and 2 and is labeled as "Prior Art."

Figure 1:
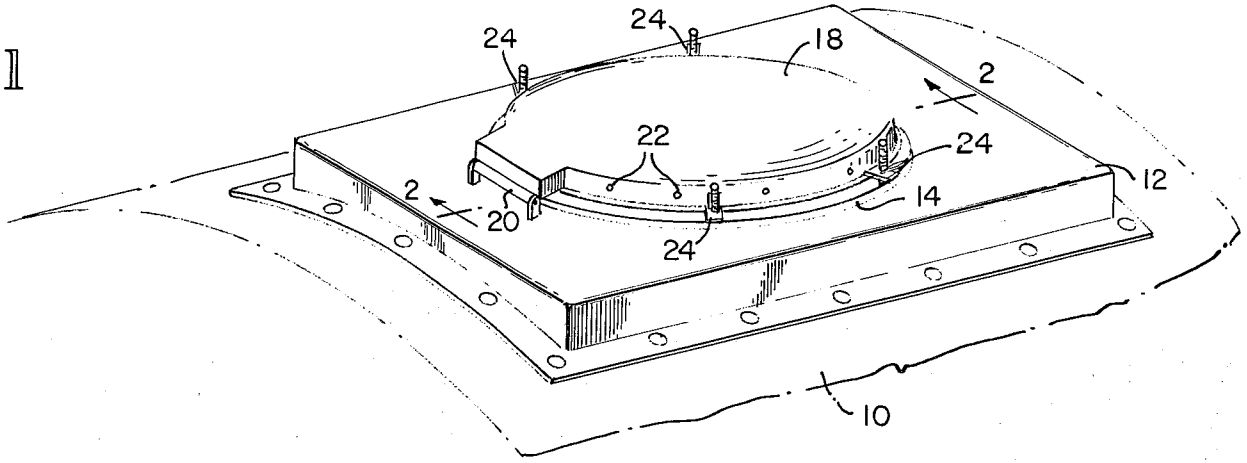
FIG. 1 PRIOR ART
FIG. 1 is a perspective view of a typical milk tank having a prior art closure assembly.

With reference to FIG. 1, there is shown in broken lines the top part of a milk tank 10 which is used to transport milk either as part of a tank truck or a tank trailer. On the top side of the tank 10, there is mounted a flat deckplate 12, with a centrally positioned support ring 14 defining an access opening 16 through which a person is able to descend into the interior of the tank 10 to inspect the tank, clean the tank or perform maintenance.

Figure 2:
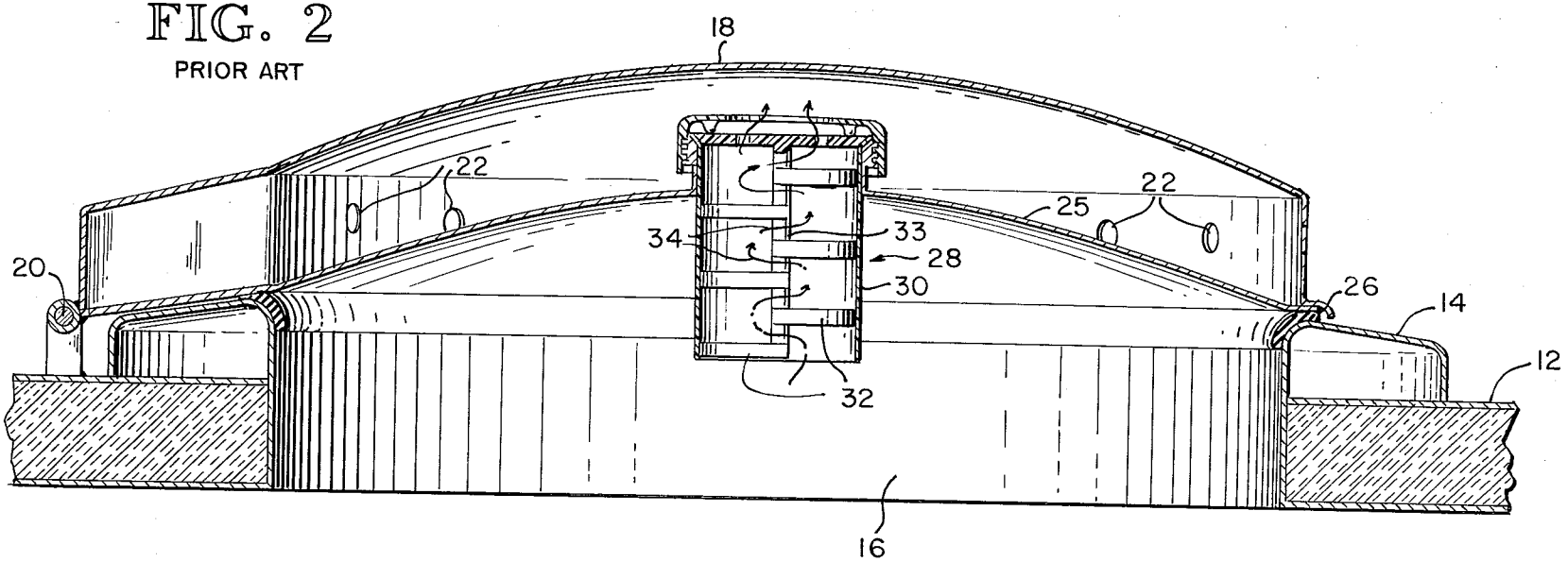
FIG. 2 PRIOR ART
FIG. 2 is a cross-sectional view taken along line 2—2 of FIG. 1 and further illustrating the prior art closure assembly shown in FIG. 1.

The prior art closure assembly shown in FIGS. 1 and 2 comprises an outside dust cover 18 which is hinge mounted at 20 to the deckplate 12. This dust cover has suitable vent openings such as those shown at 22 in the sidewall of the cover. There are several clamping members 24 by which the dust cover 18 is securely engaged in a manner to press the dust cover 18 downwardly over the support ring 14. There is a second inner cover member 25, also hinge mounted at 20, which fits under the outside cover 18.

An annular gasket 26 is provided between the support ring 14 and the periphery of the inner cover 25 to provide a circumferential seal between the inner cover 25 and the support ring 14. Mounted to the center of the inner cover 25 and extending downwardly therefrom is a venting member 28. This member 28 comprises a vertical cylindrical tube 30 in which are mounted a plurality of horizontally extending baffles 32, braced by a center rod 33. These baffles 32 are vertically spaced one from another and are positioned in staggered, overlapping relationship so as to define within the tube 30 a circuitous venting passageway (indicated by the arrows 34) along the length of the tube 30.

While the prior art assembly described above has functioned as a closure assembly in a manner to meet the standards of the dairy industry, there is still a continuing need for improvement, with regard to such things as cost of initial fabrication, ease of cleaning the components, and ease and reliability of operation.

To proceed to a description of the present invention, a first embodiment of the closure assembly of the present invention is disclosed in FIGS. 3, 4, and 5. For purposes of illustration, FIG. 3 shows the entire assembly with a portion of the outer cover broken away, and FIG. 7 shows this assembly in full. It will be noted that the configuration of the deckplate 12 and the support ring 14 are essentially the same as in the prior art structure described with reference to FIGS. 1 and 2, and these components are given the same numerical designations in FIGS. 3, 4 and 5. In the present invention, the two main components which cooperate with the support ring 14 to provide the closure assembly of the present invention are a venting closure member 36 and an outside cover 38.

The construction and functional features of the venting closure member 36 are particularly critical in the present invention, and these will be described in some detail herein. This member 36 comprises a main plate or closure portion 40 which has a circular planar configuration and extends substantially across the entire access opening 16. In the preferred form, the member 36 is molded as an integral piece from a moderately compressible or yielding material, such as silicone rubber.

The plate portion 40 of the venting closure member 36 is "crowned" (i.e., sloped moderately upwardly) at its center portion so that when it is installed, the tendency for this middle portion to sag moderately is compensated by this crowned configuration so that the upper surface of the plate 40 is nearly level, or possibly raised quite moderately with respect to the peripheral portions of the venting closure member 36. This plate portion 40 should be made sufficiently rigid to avoid undesired vibrations due to pressure pulses in the tank.

At the perimeter of the closure member 36, there is a first upper peripheral flange 42 which is co-planar with the plate portion 40 and extends radially outwardly therefrom at a distance sufficient so that in its installed position it moderately overlaps the support ring 14. There is a depending, cylindrically shaped web member 44 extending downwardly from the perimeter of the plate portion 40. This web member 44 is spaced a short distance inwardly (e.g., 1 inch) from the wall defining the access opening 16. Extending radially outwardly from the lower edge of the web member 44 is a second lower flange 46 spaced a moderate distance (e.g., 2 inches) below the upper flange 42. The diameter of the outer circumferential edge of the second lower flange 46 is just slightly greater than the inside diameter of the access opening 16.

The venting closure member 36 can be seen in its assembled position more clearly in FIG. 5. The upper interior edge of the support ring 14 is formed as a rounded lip or ridge 50 which protrudes moderately above the upper main planar surface of the ring 14. From an examination of FIG. 5, it will be noted that the outer edge of the second lower flange 46 of the venting closure member 36 presses moderately against the inner face of the inside perimeter wall 48 of the ring 14. The upper flange 42 extends moderately beyond the lip 50 of the ring 14, as at 52. The upper and lower flanges 42 and 46 cooperate with the web member 44 to define a circumferential channel 54 which reaches around the entire circumference of the venting closure member 36.

At a first location on the circumference of the member 36, the lower flange 46 is cut out to form a lower interior vent opening 56 leading from the tank interior to the channel 54. At a second circumference location on the member 36 spaced diametrically opposite from the vent opening 56 is a second exterior vent opening which is formed as cut-outs in the upper flange 42. In the particular configuration shown herein, this vent opening 58 is shown as two separate openings **58*a* and 58*b*** positioned closely adjacent one another.

The cover 38 has a main closure portion 60 of a circular, generally planar configuration and a perimeter portion 62 in the form of an annular horizontal flange positioned approximately an inch or two below the plane of the closure portion 60. The extreme outer edge of the perimeter flange 62 is formed as a downturned lip 64. The cover 38 is hinge mounted at 66, and in its closed position, the peripheral flange 62 of the cover 38 presses the upper flange 42 of the venting closure member 36 against the lip 50 of the ring 14 so as to make a seal. When the cover 38 is swung upwardly to its open position, the venting closure member 36 can easily be removed from its installed position where it extends across the access opening 16.

At a location opposite the hinge mounting 66, the cover 38 is provided with a laterally extending vent member 68. This vent member 68 is provided quite conveniently by modifying a rectangular portion of the cover 38 to form it as a boxlike member 70 which defines a lateral vent opening 72. This boxlike member 70 comprises a top wall 74 and two trapezoidal shaped side walls 76. A planar piece of filter material 78 extends entirely across the vent opening 72 to prevent dust or other foreign objects from passing into the vent opening 72. The radially inward end of the filter material 78 is positioned in a slot 80 defined by an inturned lip 82 at the radially inward end of the boxlike member 70. The inner end of the filter 78 is held in the slot 80 by means of one or more rubber buttons 84, each of which has a retaining finger 86. The radially outward end of the filter material 78 is held in place by being pressed between a cross bar 79 on the box member 70 and the flange 42 of the venting closure member 36.

To describe the operation of the present invention, in its closed position, the venting closure member 36 extends across the manhole opening 16 so that its upper flange 42 extends over the upper lip 50 of the ring 14, with the lower flange 46 pressing against the sidewall 48 of the ring 16. The cover 38 is held in its closed position by a plurality of circumferentially spaced retaining members 88 which are or may be of conventional design. As shown herein each retaining member 88 comprises an upstanding bolt member 90 mounted to the ring 14 and having thereon a nut member 92 which can be screwed down to press a retaining finger 94 downwardly against the lateral flange 62 of the cover 38.

In its closed position, the flange 42 of the venting closure member 36 provides a tight seal between the cover member 38 and the ring 14. A venting passage is provided from the interior of the tank to the surrounding atmosphere, this passage beginning at the lower flange opening 56, then through the channel section 54 in the form of two arcuate passageway sections 96 and 98 formed on opposite sides of the closure member 36, then through the upper openings **58*a* and 58*b* into an upper chamber 100 located between the cover 38 and the plate portion 40 of the venting closure member 36, and finally through the passageway 72 defined by the cover vent 68**.

After the milk tank has been filled with milk and is traveling along a road, the movement of the tank will often cause the milk to splash against the closure assembly. The milk which does move upwardly through the lower opening 56 will tend to move partially around the passageways 96 and 98 and then flow by gravity back through the opening 56. To enhance this flow-back characteristic, the lower flange 46 can be tapered along its length in such a manner that its upper surface 103 is highest at the point diametrically opposite the opening 56, with this surface 103 sloping gradually downward toward the opening 56. The openings **58*a* and 58*b* are each provided with a rather small upwardly protruding lip 104, so that any small amount of milk or liquid which may splash upwardly through these holes 58*a* and 58*b*** would not immediately run back in the hole.

With regard to possible temperature variations of the milk in the tank, as indicated earlier herein, in the event that the temperature of the milk raises even slightly, the air above the milk will likewise increase in temperature and thus increase in volume. This air is easily able to pass out the vent passageway and into the atmosphere through the passageway 76. On the other hand, the filter 78 prevents the passage of foreign objects back through the venting passageway, thus preventing possible contamination of the milk in the tank.

When the milk tank has reached its destination, as indicated earlier herein, this emptying of the tank is usually accomplished by pumping the milk through a three inch line at a rate of about 250 to 325 gallons per minute, with the tank being provided with a lower outlet valve to accomplish this unloading. So that this unloading can be accomplished without the necessity of someone going to the top of the milk tank and opening the closure assembly, the various cross-sectional areas along the length of the venting passageway are made sufficiently large so that outside air can flow into the tank through the vent passage at the same rate as milk is being discharged, with very little pressure drop of the inflowing air. It has been found that if the total cross-sectional area of the opening 56 and also of the combined openings **58*a* and 58*b* are each made 4 inches, and if the cross-sectional area of the passageways 96 and 98** are each made 2 inches, the air can flow into the tank without any pressure drop of any significance in the inflowing air.

Since there is a filter 78 in the exterior vent opening 72, the cross-sectional area of this area must be made somewhat larger, (e.g., in the order of 10 to 14 inches). With the filter material 78 being positioned in the opening 72 at an angled position, the exposed surface area of the filter 78 and the total cross-sectional area of the filter 78 transverse to the flow of air therethrough is several times larger than the total cross-sectional area of the vent passage 72. Thus, the filter 78 does not cause any substantial pressure drop of the air passing therethrough.

When it is desired to inspect the interior of the milk tank, it is quite simple matter to loosen the clamping members 88 and swing the cover 38 upwardly and down against the upper surface of the tank. The venting closure member 36 can then quite easily be lifted from the hole 16 and laid on top of the cover 38. When the closure member 36 is replaced on the ring 14, the lower flange 46 centers the closure member 36 in the opening 16, with a vertical loading rib 102 being provided in the area of the lower flange opening 56 to serve this same function.

The second embodiment of the present invention is shown in FIG. 6. Components of the second embodiment which are similar to corresponding components of the first embodiment will be given like numerical designations, with a prime (') designation identifying those components of the second embodiment. In this second embodiment, there is a cover member which is substantially identical to the cover 38 of the first embodiment. This cover is not shown in FIG. 6, since the significant features of the second embodiment can readily be understood simply by the showing in FIG. 6 of a perspective view of the venting closure member 36'.

In this second embodiment, the venting closure member 36' has the same overall configuration of the venting closure member 36 of the first embodiment. There is a center plate section 40', an upper peripheral flange 42', and a lower flange 46'. Although it is not shown in the drawing because of the angle of the perspective view, it is understood that the two flanges 42' and 46' are interconnected by a vertical web similar to the web 44 of the first embodiment.

The main difference in this second embodiment from the first embodiment is that the lower opening corresponding to the opening 56 of the first embodiment is made as two diametrically opposed openings **56*a* and 56*b*. Also, the upper set of openings 58*a* and 58*b* are now made as two diametrically opposed openings 58*c* and 58*d*. Since there are two lower openings 56*a* and 56*b*, to obtain the proper flow area for the incoming air during unloading of the milk tank, each opening 56*a* and 56*b* can be one-half the cross-sectional area of the opening 56 of the first embodiment. Likewise, the two upper openings 58*c* and 58*d* can be made the same cross-sectional area as the openings 58*a* and 58*b*** of the first embodiment.

It will be noted that the openings **58*c* and 58*d* are offset 90° with respect to the openings 56*a* and 56*b*. Thus, the peripheral channel area 54 actually provides four venting passageways, two leading from the lower opening 56*a* in oppositely directed 90° arcs, and two leading from the opening 56*b* in two oppositely directed 90° arcs. To obtain the overall cross-sectional flow area for adequate air flow during emptying of the tank, it is only necessary that these passageways in the channel 54' each have a cross-sectional area of 1 square inch. Accordingly, the two flanges 42' and 46' need only be spaced 1 inch vertically from one another, with the width of the channel 54'** being 1 inch.

The mode of operation of this second embodiment is readily apparent from the foregoing description of the operation of the first embodiment, so it will not be described in detail with respect to this second embodiment shown in FIG. 6.

The third embodiment of the invention is shown in FIG. 8. In describing this third embodiment, components which are similar to corresponding components in either the first or second embodiment will be given like numerical designations, with a double prime (") designation distinguishing those of the third embodiment.

As in the first two embodiments, the venting closure member 36" has a central plate portion 40", an upper peripheral flange 42" and a lower peripheral flange 46". In addition, there is a laterally extending intermediate flange 110 positioned midway between the upper and lower flanges 42" and 46". This divides the space between the two flanges 42" and 46" into upper and lower channels **54*a* and 54*b*. As in the second embodiment, there is formed in the lower flange 46" two diametrically opposed lower vent openings 56*a*" and 56*b*". Also, the upper flange 42" is formed with two sets of upper openings diametrically opposed from one another, each of these sets being 58*a*" and 58*b*". The intermediate flange 110 is formed with diametrically opposed openings 112 and 114, similar in sizing and configuration to the two openings 56*a*" and 56*b*". The openings 112 and 114 are offset 90° with respect to the openings 56*a*" and 56*b*". Likewise, the two sets of openings 58*a*" and 58*b*" are offset 90° with respect to the openings 112 and 114, so that actually the two sets of 58*a*" and 58*b*" are vertically aligned with the lower openings 56*a*" and 56*b*", but separated therefrom by the intermediate flange 110**.

From an examination of FIG. 8, it is quite evident that the venting passageway proceeds from the two lower openings **56*a*" and 56*b*" in four 90° arcuate paths along the lower channel 54*b* to the intermediate openings 112 and 114, thence in four 90° arcuate paths to the upper openings sets 58*a*" and 58*b*". The path from the upper openings 58*a*" and 58*b*" is then to the exterior vent opening in the cover member in a manner similar to the first embodiment. In the event that milk does splash upwardly through the openings 56***a*″ and 56*b*″, before the milk could pass entirely through the closure member 36″ it would have to travel a 90° path through the lower channel 54*b*, thence upwardly through one of the openings 112 or 114, and then through a second 90° arcuate path through the upper channel 54*a*, and only then could pass through one of the openings 58*a*″ or 58*b*″. It has been found in actual use that with this arrangement, substantially no milk is able to pass through the closure member 36″ of this third embodiment. On the other hand, this closure member 36″ provides quite adequate venting, and it permits the milk to be unloaded from the tank at a relatively rapid rate without causing any pressure drop of the air flowing back into the tank.

As indicated previously, FIG. 7 is an outside perspective view of the assembly in its closed position. Since the exterior cover 38 is the same for all three embodiments, FIG. 7 is intended to be representative of all three embodiments.

What is claimed is:

1. A closure assembly for a containing structure such as a milk tank, said containing structure defining a containing chamber to contain a liquid such as milk, the containing structure having an opening defined by a perimeter wall of a ring structure, said closure assembly comprising:

a. a venting closure member extending across said opening and having a central area and a perimeter area, said closure member being shaped to define:
   1. a perimeter venting channel extending a substantial distance along the perimeter area of the closure member,
   2. a first interior vent opening leading from said containing chamber to said venting channel at a first perimeter location,
   3. a second exterior vent opening leading from the venting channel to an area exterior of said containing chamber, said second vent opening being at a second perimeter location spaced a substantial perimeter distance from said first location.

b. a vented cover member fitting over said venting closure member and having an outside vent opening communicating with said exterior vent opening of the venting closure member, whereby the opening of the containing structure can be closed in a manner to contain said liquid securely without undue risk of contamination from outside sources, while providing a vent passage from the containing chamber to a location outside the closure assembly.

2. The assembly as recited in claim 1, said venting closure member further comprising a circumferential flange made of a yielding material and fitting over the perimeter wall of the ring structure, with said vented cover member engaging said flange so as to form a circumferential seal around said closure assembly.

3. The assembly as recited in claim 2, wherein said circumferential flange extends over a circumferential lip of said ring structure, and a perimeter portion of said vented cover member presses said flange against said circumferential lip to form said seal.

4. The assembly as recited in claim 1, wherein said venting closure member comprises upper and lower laterally extending circumferential flanges which engage said ring structure to form therewith said perimeter venting channel.

5. The assembly as recited in claim 4, wherein said first interior vent opening is formed in said lower flange, and said second exterior vent opening is formed in said upper flange at a location spaced a substantial perimeter distance from the first interior vent opening.

6. The assembly as recited in claim 4, wherein said first vent opening is provided in the form of two oppositely positioned cut-outs in said lower flange, and said second exterior vent openings is formed as two oppositely positioned cut-outs in said upper flange, offset with respect to the two lower cut-outs forming the first interior vent opening.

7. The assembly as recited in claim 1, wherein said venting closure member is provided with upper, intermediate and lower laterally extending circumferential flanges which engage said ring structure to form therewith upper and lower perimeter venting channel sections, each of said flanges having a venting opening therein, with said openings being offset circumferentially with respect to one another so as to form a venting passageway through an opening in the lower flange, thence along said lower channel section through the opening in the intermediate flange, thence along said upper channel section to the opening in the upper flange.

8. The assembly as recited in claim 1, wherein said venting closure member is provided with upper, intermediate and lower laterally extending circumferential flanges which engage said ring structure to form therewith upper and lower sections of said perimeter venting channel, said lower flange having oppositely positioned venting openings therein, said intermediate flange having oppositely positioned venting openings therein which are offset with respect to the openings in the lower flange, and said upper flange having oppositely positioned venting openings offset with respect to the openings in the intermediate flange.

9. A closure assembly for a containing structure, such as a milk tank, defining a containing chamber to contain a liquid, such as milk, said containing structure having an opening defined by a perimeter wall of a ring structure surrounding said opening, said closure assembly comprising:

a. a vented cover member fitting over said opening, said vented cover member having a main cover portion and a perimeter portion fitting over the ring structure of the containing structure, b. a venting closure member fitting over said containing opening at a location below said vented cover member, said venting closure member comprising:
   1. a main plate portion extending across said containing structure opening,
   2. a first upper perimeter flange extending laterally over said ring structure to form a seal between the perimeter portion of the vented cover member and said ring structure,
   3. at least one lower perimeter flange extending laterally to engage the perimeter wall of the ring structure and form with the upper flange and the perimeter wall a circumferential venting channel,
   4. said venting closure member being provided with a first interior opening leading from the interior of said containing structure into said venting channel, and a second exterior opening leading from said venting channel to an area between said vented cover member and said venting closure member, said interior and exterior openings being spaced circumferentially with respect to one another, whereby the opening of the containing structure can be closed in a manner to contain said liquid securely without undue risk of contamination from an outside source, and there is also provided a venting passage from the lower opening of the closure structure through said venting channel to said exterior opening of the venting closure structure.

10. The assembly as recited in claim 9, wherein said vented cover member is provided with a structure defining a laterally extending outside vent opening, connecting with the exterior vent opening of the venting closure member through the area between the vented cover member and the venting closure member.

11. The assembly as recited in claim 10, wherein said outside lateral vent opening has a filter material positioned therein to permit air flow through the outside vent opening while preventing foreign material from entering the outside vent opening.

12. The assembly as recited in claim 9, wherein said assembly is adapted to be used with a containing structure having means for discharging contained liquid therefrom within a predetermined range of discharge rates, and the interior opening, the exterior opening and the venting channel of the venting closure member having cross-sectional areas sufficiently large to permit an inflow of air equal to the discharge rate of the liquid, without creating any substantial pressure drop of air flowing through the outside opening, through the venting channel and through the interior opening into the interior of the containing structure.

13. The assembly as recited in claim 12, wherein said cover member has a vent opening with a cross-sectional area substantially larger than both the interior and exterior opening of the venting closure member, and said outside opening of the cover member having a filter material therein to permit inflow of air therethrough at a rate equal to the rate of the discharge of the liquid of the tank, without causing substantial pressure drop of air flowing through the filter material.

14. The assembly as recited in claim 9, wherein said lower flange is provided with two openings positioned oppositely one another, and said upper flange has at least one opening offset with respect to the two lower openings.

15. The assembly as recited in claim 14, wherein said upper flange is provided with two upper openings, oppositely positioned with respect to one another and offset with respect to the two openings in the lower flange.

16. The assembly as recited in claim 9, wherein said venting closure member has a third flange positioned below the second lower flange, said third flange defining a second venting channel section below the first named venting channel, said third flange being provided with an opening offset from the opening in the second lower flange.

17. The assembly as recited in claim 16, wherein said first upper flange is provided with two oppositely positioned openings, said second flange is provided with at least two openings offset with respect to the openings in the first upper flange, and the third lowermost flange is provided with at least two oppositely positioned openings offset with respect to the openings in the second flange, said openings communicating with one another through said venting channels.

18. In a containing structure, such as a milk tank, defining a containing chamber to contain a liquid, such as milk, the containing structure having an opening defined by a perimeter wall of a ring structure surrounding the opening, and an outside cover fitting over said opening, with said vented cover member having a main cover portion and a perimeter portion fitting over the ring structure of the containing structure, the improvement comprising a venting closure member adapted to accomplish the three-fold functions of:

a. providing a seal between the cover member and the ring structure,
b. closing said containing structure opening from the cover member, and
c. provide venting from the containing chamber through said containing structure opening, said venting closure member comprising:

a. a main plate portion adapted to extend across said containing structure opening,
b. a first upper perimeter flange extending laterally from said plate portion and adapted to fit over said ring structure so as to form a seal between the perimeter portion of the cover member and the ring structure,
c. at least one lower laterally extending perimeter flange adapted to engage the perimeter wall of the ring structure and form with the upper flange and the perimeter wall a circumferential venting channel, and
d. said venting closure member being provided with a first lower opening leading into said venting channel and adapted to communicate with the interior of said containing structure, and a second upper opening leading from the venting channel and adapted to communicate to an area between said vented cover member and said venting closure member, said upper and lower openings being spaced circumferentially with respect to one another, whereby the opening of the containing structure can be closed to contain said liquid securely without undue risk of contamination from an outside source, and there is also provided a venting passage from the lower opening through the venting channel to the upper opening.

19. The venting closure member as recited in claim 18, wherein said lower flange is provided with two lower openings positioned oppositely one another, and said upper flange has at least one opening offset with respect to the two lower openings.

20. The venting closure member as recited in claim 19, wherein said upper flange is provided with two upper openings, oppositely positioned with respect to one another and offset with respect to the two openings in the lower flange.

21. The venting closure member as recited in claim 18, wherein the venting closure member has a third flange below the second lower flange, said third flange defining a second venting channel below the first named venting channel, said third flange being provided with an opening offset from the opening of the second lower flange.

22. The venting closure member as recited in claim 21, wherein said first upper flange is provided with two oppositely positioned openings, said second flange is provided with at least two openings offset with respect to the openings in the first upper flange, and the third lowermost flange is provided with at least two openings offset with respect to the openings in the second flange, said openings communicating with one another through said venting channels.

* * * * *